US006250248B1

(12) United States Patent
Patera

(10) Patent No.: US 6,250,248 B1
(45) Date of Patent: Jun. 26, 2001

(54) SAFETY SIGNALING APPARATUS FOR PERSONAL WATER CRAFT

(76) Inventor: John M. Patera, 6155 Lance Rd., Medina, OH (US) 44256

( * ) Notice: Subject to any disclaimer, the term of this patent is extended or adjusted under 35 U.S.C. 154(b) by 0 days.

(21) Appl. No.: 09/443,570

(22) Filed: Nov. 19, 1999

Related U.S. Application Data

(60) Provisional application No. 60/109,838, filed on Nov. 25, 1998.

(51) Int. Cl.[7] ..... G09F 17/00; G08B 23/00

(52) U.S. Cl. ..... 116/209; 116/173; 114/343; 340/984

(58) Field of Search ..... 116/209, 173, 116/28 R, 35 R, 46, 284, 286, 303; 114/343, 347, 348, 364, 270; 340/984, 988, 384.1; 33/391, 333, 354, 370, 366.11, 366.24, 366.25, 366.26, 366.27

(56) References Cited

U.S. PATENT DOCUMENTS

| | | | | |
|---|---|---|---|---|
| 955,799 | * | 4/1910 | Holbrook | 33/354 |
| 2,966,674 | * | 12/1960 | Clark | 340/384.1 |
| 3,122,736 | | 2/1964 | Weber . | |
| 3,520,273 | | 7/1970 | Daifotes . | |
| 3,760,441 | * | 9/1973 | Handelman | 116/173 |
| 3,872,529 | | 3/1975 | Wainwright . | |
| 3,967,575 | | 7/1976 | Coutts . | |
| 4,052,697 | | 10/1977 | Daifotes . | |
| 4,080,924 | | 3/1978 | LeClaire . | |
| 4,122,796 | | 10/1978 | Pressler et al. . | |
| 4,228,556 | * | 10/1980 | Searls | 114/190 |
| 4,274,127 | | 6/1981 | Beck et al. . | |
| 4,599,965 | * | 7/1986 | Johnson | 116/173 |
| 4,640,213 | | 2/1987 | Lugo . | |
| 4,782,784 | | 11/1988 | Little . | |
| 4,871,996 | * | 10/1989 | Tsunameto et al. | 340/984 |
| 4,896,623 | * | 1/1990 | Seibert et al. | 116/173 |
| 4,962,720 | | 10/1990 | Leffel . | |
| 5,168,828 | * | 12/1992 | Smyly, Sr. | 116/173 |
| 5,343,825 | * | 9/1994 | Gazecimeon et al. | 116/173 |
| 5,398,026 | | 3/1995 | Handsaker . | |
| 5,403,219 | * | 4/1995 | Ryan | 116/173 |
| 5,421,287 | * | 6/1995 | Yonover | 116/209 |
| 5,596,944 | | 1/1997 | Massie . | |
| 6,057,787 | * | 5/2000 | Kell et al. | 116/173 |
| 6,062,160 | * | 5/2000 | Delcambre | 116/28 R |

* cited by examiner

*Primary Examiner*—Andrew H. Hirshfeld

(57) ABSTRACT

A safety signaling apparatus for personal water craft (PWC) which increases the visibility of a personal water craft when the PWC is in a moving, stopped, or capsized position. The apparatus comprises a pendulum signaling arm (15) in pivoting connection with a mounting device. The mounting device includes a pivot bolt (28) threaded into a clamp (21). The mounting device is operative to removably attach the apparatus to a bumper of a PWC. The pendulum signaling arm includes a counterweight (26), a flotation tube (16), and a signaling device (14) such as flag, light, or siren. The signaling device works completely automatically using gravity and flotation, with the flotation tube and the pendulum counterweight to create a pendulum counterweight flotation action which maintains the signaling device in an upright position above the PWC. The pendulum signaling arm is straight up when the PWC is in a stopped position, as the PWC begins to move, the air flow rotates the pendulum signaling arm in a circular motion to an angular position. When the PWC is capsized the pendulum signaling arm rotates to maintain the signaling device in an upright position above the PWC.

15 Claims, 3 Drawing Sheets

SAFETY SIGNALING APPARATUS FOR PERSONAL WATER CRAFT

This application claims benefit of Provisional No. 60/109,838 filed Nov. 25, 1999.

TECHNICAL FIELD

This invention relates to a safety signaling apparatus for personal water craft. Specifically this invention relates to a new signaling apparatus that provides increased visibility and safety for personal water craft users.

BACKGROUND ART

Personal water craft use has become an increasingly popular sport; however, it can be a very dangerous sport Examples of a personal water craft (PWC) include water jet-propelled crafts such as the JetSking and Waverunnering. However for purposes of the present invention a PWC applies to any low profile water craft that is difficult to see from the perspective of other water craft. When a PWC capsizes for example (a common occurrence with JetSki type craft), waves, sun, and other weather conditions can make a PWC very difficult to see. Consequently there is a need to provide a signaling device for a PWC that increases the visibility and overall safety of a PWC when the craft is both upright and capsized.

Several systems have been devised for other vehicles and water craft; however, each one has one or more significant drawbacks. One such system, shown in U.S. Pat. No. 4,640,213 to Lugo (1987) shows a signal flag apparatus for mounting on a motor boat. This apparatus is designed to work when pulling a water skier and is not an effective safety device when the boat is capsized.

Pressler in U.S. Pat. No. 4,122,796 (1978) shows a signal apparatus similar to Lugos. This device has many of the disadvantages of Lugo's, and in addition, is complex and more expensive to manufacture.

Handsaker in U.S. Pat No. 5,398,026 (1995) shows a light or distress signaling transmitter which is electrically activated. This device would be difficult to mount on a PWC. Because this is an electronic device, it may not work when a PWC is capsized. Finally, the Handsaker device is complex and more expensive to manufacture.

Massie in U.S. Pat. No. 5,596,944 (1997) shows a boat trailer marking device. As with previous signaling devices, this would not be adaptable to a PWC.

Leffel in U.S. Pat. No. 4,962,720 (1990) shows a self-storing flag assembly for mounting to a boat. Once again, this device would not adapt to a PWC.

Daifotes in U.S. Pat. No. 3,520,273 (1969) shows a flare device mounted to a bumper of a car. This device also can not be adapted to a PWC. This apparatus is expensive and complex.

Daifotes in U.S. Pat. No. 4,052,697 (1977) shows a fold up spring loaded arm mounted on a vehicle and housing a folded flag. This device has the same shortcomings as Daifotes previous patent.

Coutts in U.S. Pat No. 3,967,575 (1976) shows a safety signal warning flag for mounting on bicycles. This device is unadaptable to PWC and would not work should the PWC capsize.

Wainwright in U.S. Pat. No. 3,872,529 (1975) shows a belt adapted to fit the waist of a swimmer to be used as a warning flag. Similar to prior patents, this would not adapt well to a PWC. Should the PWC capsize, this device would not work.

LeClaire in U.S. Pat. No. 4,080,924 (1978) shows an oscillating signaling device using a flag or reflector. This device has many of the disadvantages of Handsaker's.

Weber in U.S. Pat. No. 3,122,736 (1964) shows a safety signaling device for a swimmer. This device is very similar to Wainwright's and thus has the same disadvantages.

Beck in U.S. Pat No. 4,274,127 (1981) shows a safety illumination device for a wheeled vehicle such as a bicycle. As with the previous patents, this is unadaptable to PWC.

Consequently, there exists a need for signaling apparatus that is adaptable to a PWC and is operative to warn other water craft of the presence of the PWC when the PWC is stopped, moving, or capsized.

DISCLOSURE OF INVENTION

It is an object of the present invention to provide a signaling apparatus for a PWC.

It is a further object of the present invention to provide a signaling apparatus for a PWC that increases the safety of the PWC.

It is a further object of the present invention to provide a signaling apparatus for a PWC that increases the visibility of the PWC.

It is a further object of the present invention to provide a signaling apparatus for a PWC that increases the visibility of the PWC when the craft is moving, stopped or capsized.

It is a further object of the present invention to provide a signaling apparatus for a PWC that automatically maintains a flag in an upright position above the PWC when the PWC is capsized.

It is a further object of the present invention to provide a signaling apparatus for a PWC that provides an audible signal when the PWC is capsized.

It is a further object of the present invention to provide a signaling apparatus for a PWC that is easily installed on a PWC.

It is a further object of the present invention to provide a signaling apparatus for a PWC that can be mounted to new and existing PWCs.

It is a further object of the present invention to provide a signaling apparatus for a PWC that is portable.

It is a further object of the present invention to provide a signaling apparatus for a PWC that is relatively economical to make.

Further objects of the present invention will be made apparent in the following Best Modes for Carrying Out Invention and the appended claims.

The foregoing objects are accomplished in one exemplary embodiment of the invention by a safety signaling apparatus for a personal water craft (PWC) that comprises a signaling device in operative connection with a rotating pendulum signaling arm. The pendulum signaling arm includes a counterweight portion and flotation portion which is operative to maintain the signaling device in an upright position above the PWC when the PWC is in a stopped, moving, or capsized position. In an exemplary embodiment the signaling device includes a flag on top of a long pole. However, in alterative embodiments the signaling device includes reflectors, sirens, horns, flashing lights or any other warning device that is operative to alert persons in the vicinity of the PWC of the presence of the PWC.

BEST MODES FOR CARRYING OUT INVENTION

Figure 1:
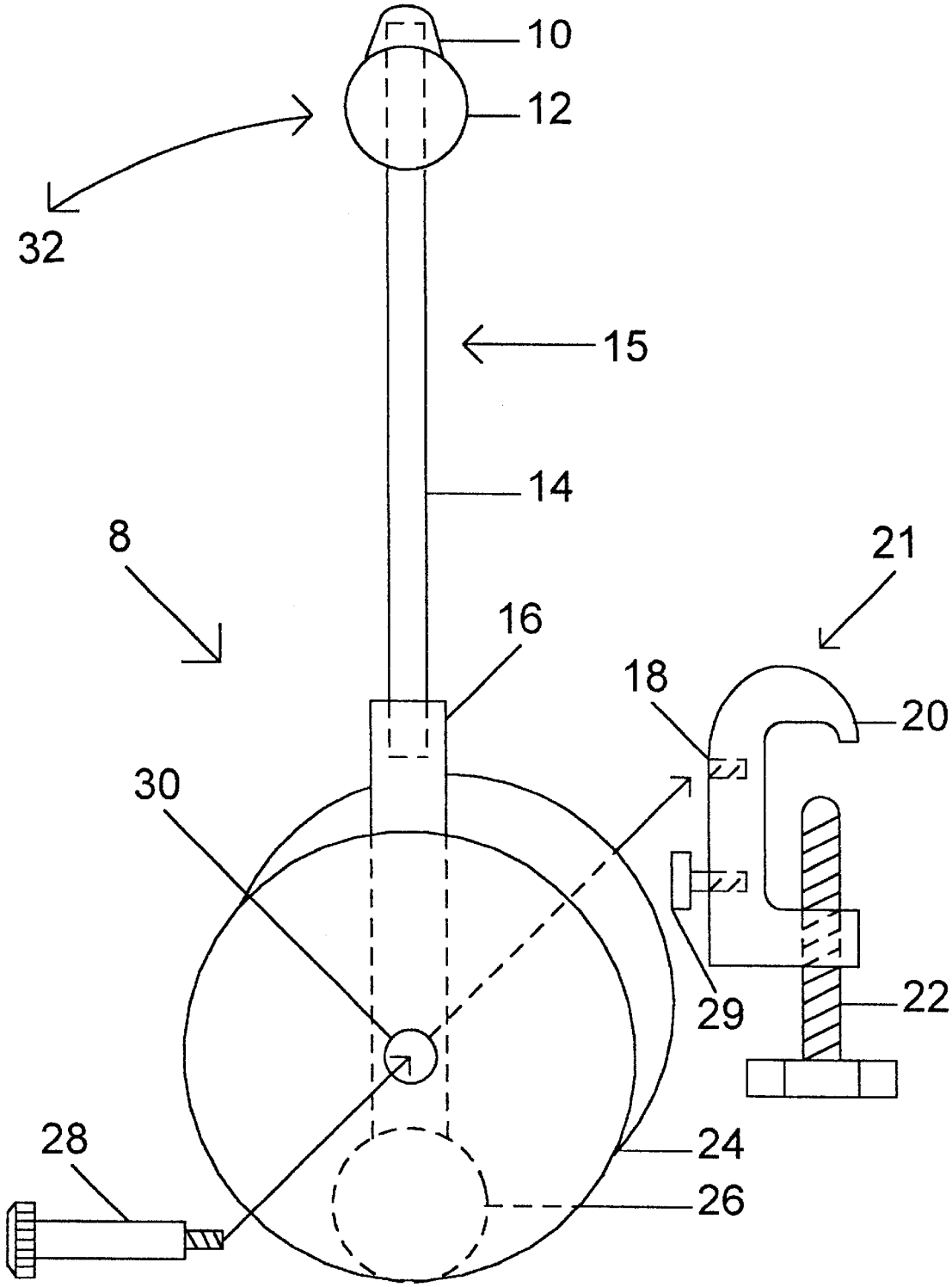
FIG. 1 is an overall perspective view of the safety signaling apparatus.

Referring now to the drawings and particularly to FIG. 1, there is shown therein, a schematic view representative of an exemplary embodiment of my safety signaling apparatus for personal water craft (PWC) 8. Here the safety signaling apparatus 8 includes pendulum signaling arm 15 in pivoting connection with a mounting device. In this exemplary embodiment the mounting device includes a pivot pin or pivot bolt 28 in operative connection with a bumper clamp 21 for mounting the apparatus to a PWC. The pendulum signaling arm is operative to rotate backward and forward about the pivot bolt 28 in a pendulum rotation 32.

The pendulum signaling arm 15 includes a counterweight 26, a flotation portion 16, and a signaling device 12. In the exemplary embodiment the signaling device includes a flag, (which may be reflective) light, siren, or any other warning device operative to signal the presence or location of the PWC. In the exemplary embodiment, a connection rod 14 between the signaling device 12 and the floatation portion 16 is operative to provide the signaling device with increased elevation above the PWC for increasing the effectiveness of the signaling device. The connection rod is constructed of a flexible plastic or fiberglass rod. However, in an alternative embodiment the connection rod 14 may be adjustable in length or telescopic to move the signaling device between an upper and lower position.

The counter weight is located on the lower end of the pendulum signaling arm on the opposite side of the pivot bolt 28 from the flotation portion 16 and signaling device 12. In this arrangement the counter weight is operative to bias the pendulum signaling arm in a vertical position so that the signaling device is maintained in an elevated position with respect the PWC. In the exemplary embodiment the pendulum counterweight is comprised of a heavy, weighted, and non-corrosive material like lead.

The flotation portion 16 in the exemplary embodiment is comprised of a foam filled cpvc plastic pipe or conduit tube. When the apparatus is within water, the floatation portion 16 is operative to further bias the pendulum signaling arm in a vertical position.

In addition the pendulum signaling arm may include a flotation safety tip protector 10 made of a floating flexible rubber and located adjacent the signaling device. The safety tip protector is operative to further bias the pendulum signaling arm to rotate when the PWC is capsized.

Figure 2:
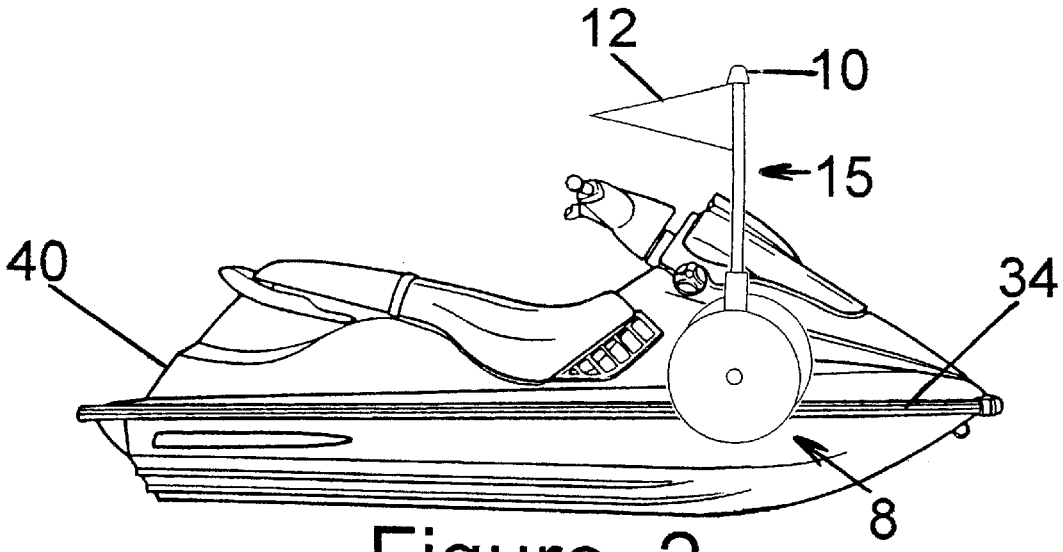
FIG. 2 is a perspective view of the safety signaling apparatus mounted on a personal water craft (PWC) in a stopped position.

In the exemplary embodiment the pendulum signaling arm rotates between two disposed sides of a weather deflector guard 24 comprised of a flexible shock resistant plastic. The pendulum signaling arm 15 and weather guard 24 are fastened together by the pivot bolt 28 which passes thru hole 30 and threads into threaded hole 18 of the clamp 21. In alternative embodiments the deflector weather guard 24 and the bumper clamp 21 may be molded in one piece The bumper clamp 21 in the exemplary embodiment is molded or machined of a very strong plastic material. The bumper clamp 21 includes a clamping body 20 adapted to correspond to the contour of a PWC bumper. The clamping screw 22 is also constructed of a strong non-corrosive metal to secure the bumper clamp 21 to the PWC bumper. A fastening bolt 29 threaded into the claim 20 is operative to provide stability. FIG. 2 shows an exemplary placement of the safety signaling apparatus 8 positioned on a bumper 34 of a PWC 40. In alternative embodiments the safety signaling apparatus 8 may be positioned on the back bumper of the PWC 40 to allow the pendulum signaling arm 15 to rotate even when the PWC is only partially capsized on its side.

The bumper clamp 21 is a mounting device which may be easily mounted and removed from the bumper of a PWC. However, in alternative embodiments of the present invention the pivot bolt 28 may be directly threaded into the hull of the PWC for a more permanent mounting.

Figure 3:
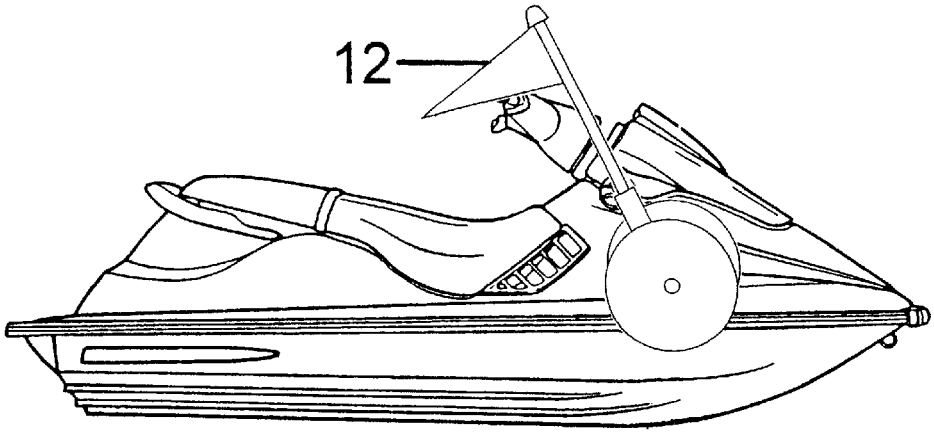
FIG. 3 is a perspective view of a safety signaling apparatus mounted on a PWC in a moving position.
Figure 4:
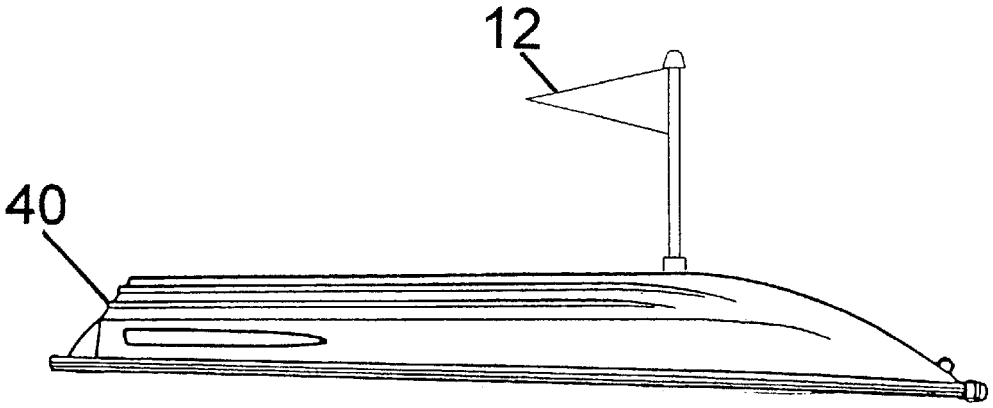
FIG. 4 is a perspective view of the safety signaling apparatus mounted on a PWC in a capsized position.
Figure 5:
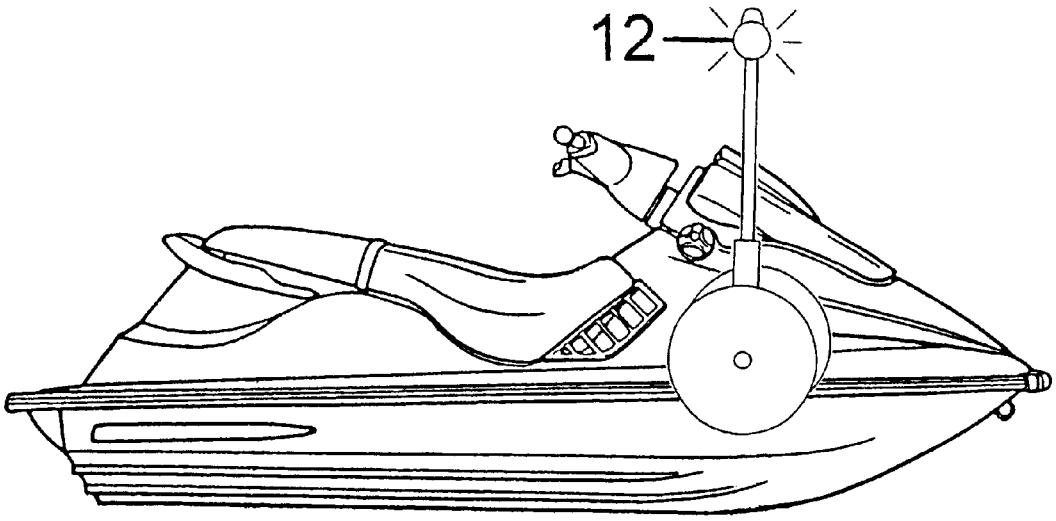
FIG. 5 is a perspective view of the safety signaling apparatus mounted on a personal water craft (PWC), wherein the signaling apparatus includes a signaling device in the form of a light source.
Figure 6:
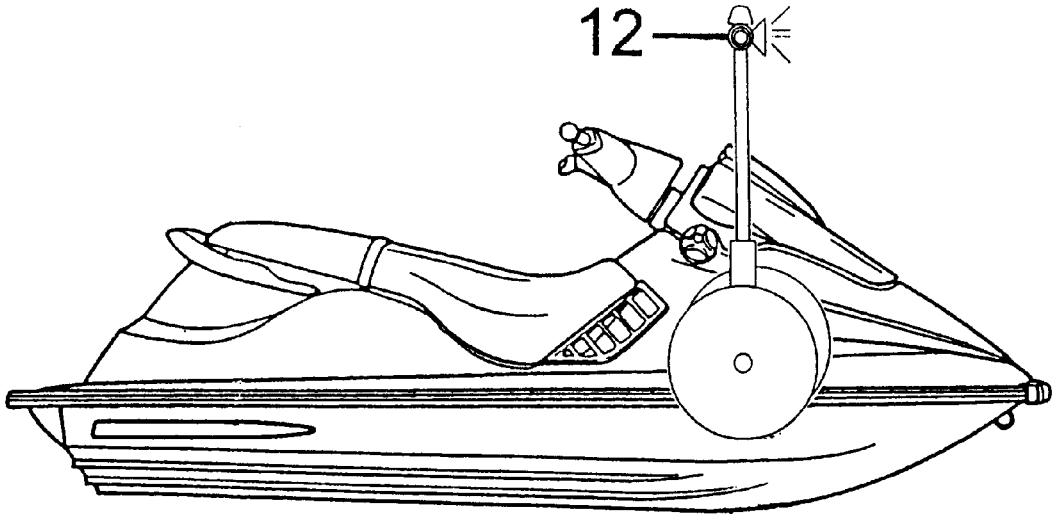
FIG. 6 is a perspective view of the safety signaling apparatus mounted on a personal water craft (PWC), wherein the signaling apparatus includes a signaling device in the form of a sound source.

In operation the pendulum signaling arm 15 pivots about the pivot bolt 28 on a 180 or 360 degree pendulum rotation 32. FIGS. 2, 3 and 4 show the signaling pendulum 15 in various angular positions with respect to a PWC 40, when the PWC 40 is in a stopped, moving, and capsized position.

As shown in FIG. 2, the pendulum counterweight 26 has sufficient weight to hold the signaling arm 15 in a vertical upright position when the PWC is in a stopped position, However, as shown in FIG. 3, when the PWC 40 is moving, the exemplary pendulum counterweight 26 is sufficiently light to allow the wind forces acting on the pendulum signaling arm 15 to rotate the pendulum signaling arm 15 to an angular position with respect to the PWC 40.

As shown in FIG. 4, when the PWC 40 is capsized the pendulum counterweight in combination with the flotation portion and the flotation safety tip protector are operative to rotate the pendulum signaling arm, 180 degrees so that the signaling device 12 remains in a position above the PWC 40. The pendulum signaling arm is biased to this vertical position with the downward movement from the force of the pendulum counterweight 26 and upward movement from the force of the flotation tube 16 and flotation safety tip protector 10.

In the exemplary embodiment of the present invention all elements are comprised of non-corrosive, water and UV resistant materials.

Accordingly, it can be seen that the safety signaling apparatus for personal water craft can be installed on new and existing PWC easily, economically, and without altering the PWC body. The present invention is also portable and self contained so it can be easily transferred from one PWC to another. The safety signaling apparatus increases visibility providing safety among water craft users by enabling other water craft to visually locate and determine the position of the PWC whether it be stopped, moving, or capsized.

Alternative embodiments may include different, interchangeable colored flags. For example, the signaling device can include a yellow flag which shows caution or a red flag which shows distress. Also the signaling device may include flags with different shapes and/or reflective properties. Other embodiments may include flags with popular designs such as the logos of popular sports teams, or commercial products.

In addition the signaling device may include flashing or steady lights and sound emitting devices such as a horn or siren. These devices may be operative to either flash or emit sound responsive to the angular position of the pendulum signaling arm with respect to the PWC. For example if the PWC is capsized, and the pendulum signaling device has rotated 180 degrees from its normal position, a water proof angle sensing circuit could be employed to activate a light source or siren in the signaling device.

Thus the safety signaling apparatus for personal water craft achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. A personal water craft signaling apparatus comprising:

a pendulum signaling arm, wherein the pendulum signaling arm includes a signaling device;

a mounting device in pivoting connection with the pendulum signaling arm, wherein the mounting device is operative to mount the pendulum signaling arm to a personal water craft, wherein the pendulum signaling arm is biased to move the signaling device in a position above the personal water craft; and a deflector guard in operative connection with the mounting device, whereby the deflector guard is operative to shield a portion of the pendulum signaling arm from forces of moving water and wind, wherein the deflector guard includes two opposed sides and the pendulum signaling arm is operative to rotate between the two sides.

2. A personal water craft signaling apparatus comprising:

a pendulum signaling arm, wherein the pendulum signaling arm includes a signaling device; and a mounting device in pivoting connection with the pendulum signaling arm, wherein the mounting device is operative to mount the pendulum signaling arm to a personal water craft, wherein the pendulum signaling arm is biased to move the signaling device in a position above the personal water craft said signaling device being operative to emit a signal responsive to the angular position of the pendulum signaling arm with respect to the personal water craft.

3. A personal water craft signaling apparatus according to claim 2, wherein the pendulum signaling arm includes two opposed ends, wherein the first end includes the signaling device, and wherein the second end includes a counter weight, wherein the counter weight is operative to gravitationally bias the signaling device in a position above the personal water craft.

4. The personal water craft signaling apparatus according to claim 3, wherein the signaling device includes a flag.

5. The personal water craft signaling apparatus according to claim 3, wherein the signaling device includes reflectors.

6. The personal water craft signaling apparatus according to claim 3, wherein the signaling device includes an adjustable length portion between the signaling device and the counter weight, whereby the height of the signaling device can be increased or decreased.

7. The personal water craft signaling apparatus according to claim 2, further comprising a deflector guard in operative connection with the mounting device, whereby the deflector guard is operative to shield a portion of the pendulum signaling arm from the forces of moving water and wind.

8. The personal water craft signaling apparatus according to claim 7, wherein the deflector guard includes two opposed sides, wherein the pendulum signaling arm is operative to rotate between the two sides.

9. The personal water craft signaling apparatus according to claim 2, wherein the mounting device includes a pivot pin, wherein the pendulum signaling arm is operative to pivot about the pivot pin.

10. The personal water craft signaling apparatus according to claim 2, wherein the pendulum signaling arm includes a flotation portion, wherein when the floatation portion is within water, the flotation portion is operative to bias the signaling device in a position above the personal water craft.

11. The personal water craft signaling apparatus according to claim 2, wherein the signaling device is in removable connection with the pendulum signaling arm.

12. The personal water craft signaling apparatus according to claim 2, wherein the signal is a siren.

13. The personal water craft signaling apparatus according to claim 2, wherein the signal is a flashing light.

14. The personal water craft signaling apparatus according to claim 2, wherein the mounting device includes an adjustable clamp.

15. The personal water craft signaling apparatus according to claim 14, wherein the clamp is operative to mount the pendulum signaling arm to the bumper portion of a personal water craft.

* * * * *